United States Patent [19]

Kito

[11] Patent Number: 4,644,765

[45] Date of Patent: Feb. 24, 1987

[54] CONTINUOUS TREATING SYSTEM FOR WIDE CLOTH

[75] Inventor: Kiyoharu Kito, Nagoya, Japan

[73] Assignee: Nippon Dyeing Machine Mfg. Co., Ltd., Aichi, Japan

[21] Appl. No.: 724,124

[22] Filed: Apr. 17, 1985

[51] Int. Cl.[4] ..... D06B 3/10

[52] U.S. Cl. ..... 68/62; 68/158; 68/177; 68/205 R; 68/207

[58] Field of Search ..... 68/158, 177, 205 R, 68/207, 62

[56] References Cited

U.S. PATENT DOCUMENTS 4,231,238 11/1980 Sando et al. ..... 68/158 X

FOREIGN PATENT DOCUMENTS 1944304 3/1971 Fed. Rep. of Germany ..... 68/158

43163 3/1984 Japan ..... 68/177

*Primary Examiner*—Philip R. Coe

*Attorney, Agent, or Firm*—Martin A. Farber

[57] ABSTRACT

In a continuous treating system for a wide cloth which continuously treats the wide cloth while the cloth is being conveyed and passed through a treating tank by a conveyor disposed inside the treating tank, the improvement wherein zigzag motion is applied to a single endless conveyor itself along the rotation of the conveyor and a guide member such as a net or a guide bar is stretched along the zone of the zigzag movement of the conveyor in such a manner that the cloth is passed through the zone; and a treating liquid is jetted to the cloth inside the zigzag movement zone from both sides of the cloth.

5 Claims, 5 Drawing Figures

CONTINUOUS TREATING SYSTEM FOR WIDE CLOTH

BACKGROUND OF THE INVENTION

1. Field of the Invention

This invention relates to a continuous treating system for a wide cloth.

2. Description of the Prior Art

A conventional system of the kind described above has a construction such as shown in FIG. 1 of the accompanying drawings in which upper and lower conveyors are disposed transversly and a fluid or a gas is jetted at both sides of the cloth passing through the gap between the upper and lower conveyors in order to impart a zigzag motion to the cloth and to obtain a rumpling effect. However, large quantities of the fluid are required to jet the fluid to the cloth, and hence the necessary pumping power is also great. When a liquid jet driven by a pump is used, cavitation is likely to develop due to foaming; hence performance is likely to be reduced, or the jet ports of the jet pipes are likely to be clogged by scale and waste cloth.

SUMMARY OF THE INVENTION

In view of the problems of the prior art system described above, the present invention contemplates realizing the zigzag motion of the cloth, which imparts a rumpling effect to the cloth, by means of the zigzag motion of a conveyor itself in cooperation with the jet operation described above without relying solely upon the jet operation of the fluid.

In a system which continuously treats a wide cloth while the cloth is being conveyed and passed through a treating tank by a conveyor disposed in the treating tank, the continuous treating system in accordance with the present invention is characterized in that a zigzag motion is imparted to the conveyor itself with the rotation of the conveyor, a guide member such as a net or a guide bar is stretched along the zone of the zigzag motion of the conveyor so that the cloth is conveyed through the zone, and a treating liquid is jetted to the cloth from both sides of the cloth.

The above and other objects, features and advantages of the present invention will become more apparent from the following description to be taken in conjunction with the accompanying drawings.

DESCRIPTION OF THE PREFERRED EMBODIMENT

Figure 1:
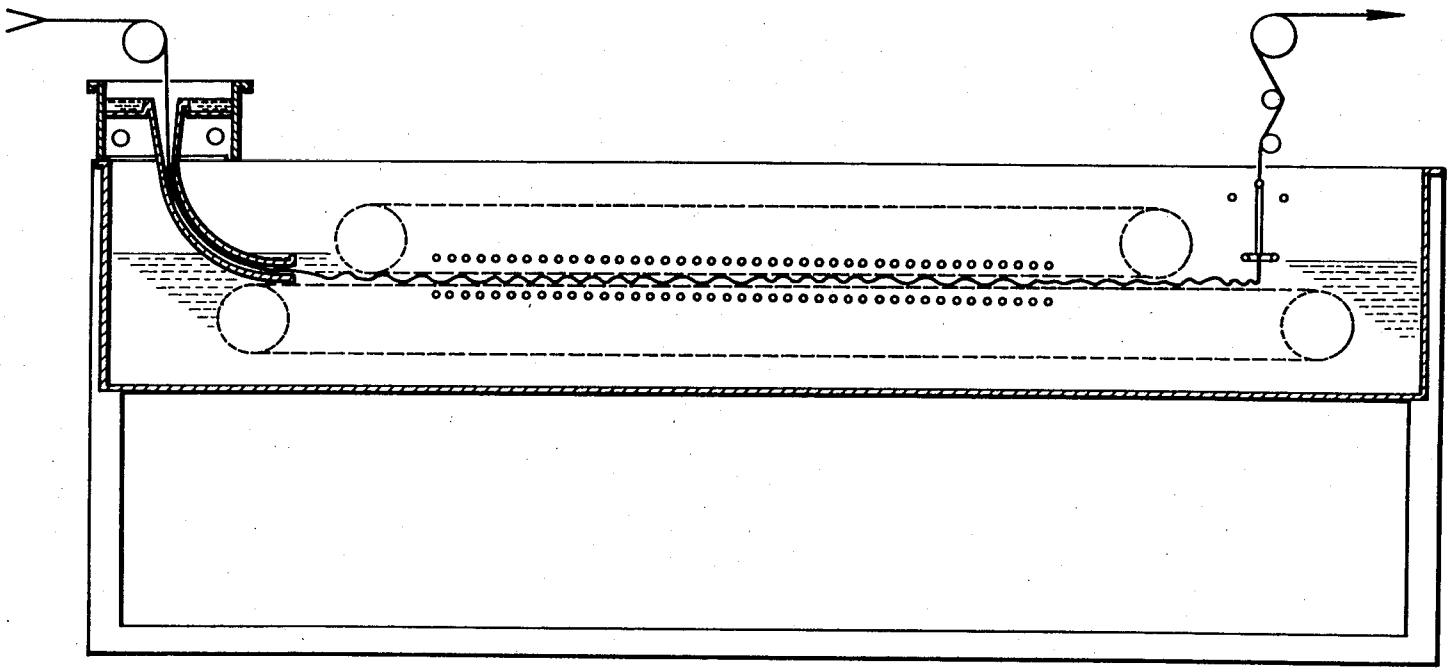
FIG. 1 PRIOR ART
FIG. 1 is a sectional side view of a conventional treating system.
Figure 2:
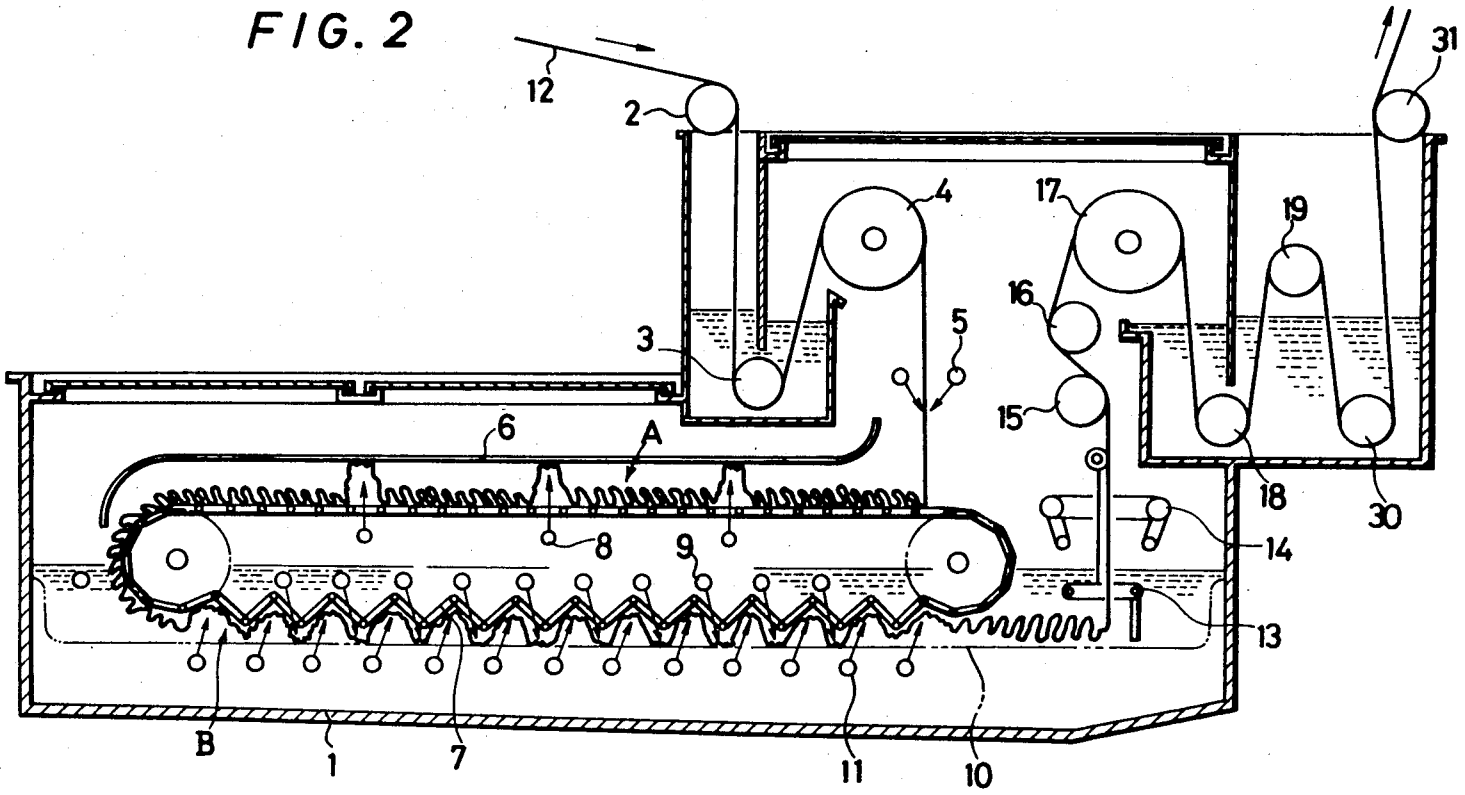
FIG. 2 is a sectional side view of a treating system in accordance with one embodiment of the present invention.

Next, one preferred embodiment of the present invention will be described with reference to the accompanying drawings. As shown in FIG. 2, a cloth guide 6 is disposed at the upper portion of, and inside, a treating tank 1, and an endless conveyor 7 is stretched below the guide 6 between a drive shaft and a follower shaft.

The conveyor 7 and the guide bar 6 define a gap between them which serves as a cloth treating passage A. Jet pipes 8 and 9 are disposed at the upper and lower portions of, and inside, the conveyor 7 in such a fashion that their jet ports face the cloth passage. A net 10 is stretched transversely below the conveyor 7. The gap between the net 10 and the conveyor 7 serves as a cloth treating passage B.

Jet pipes 11 are disposed below the net 10 in such a fashion that their jet ports face the cloth passage. The jet pipes 9 and 11 are disposed alternately, and the jet pipes 11 are disposed inside the gaps of the line of jet pipes 9.

Figure 3:
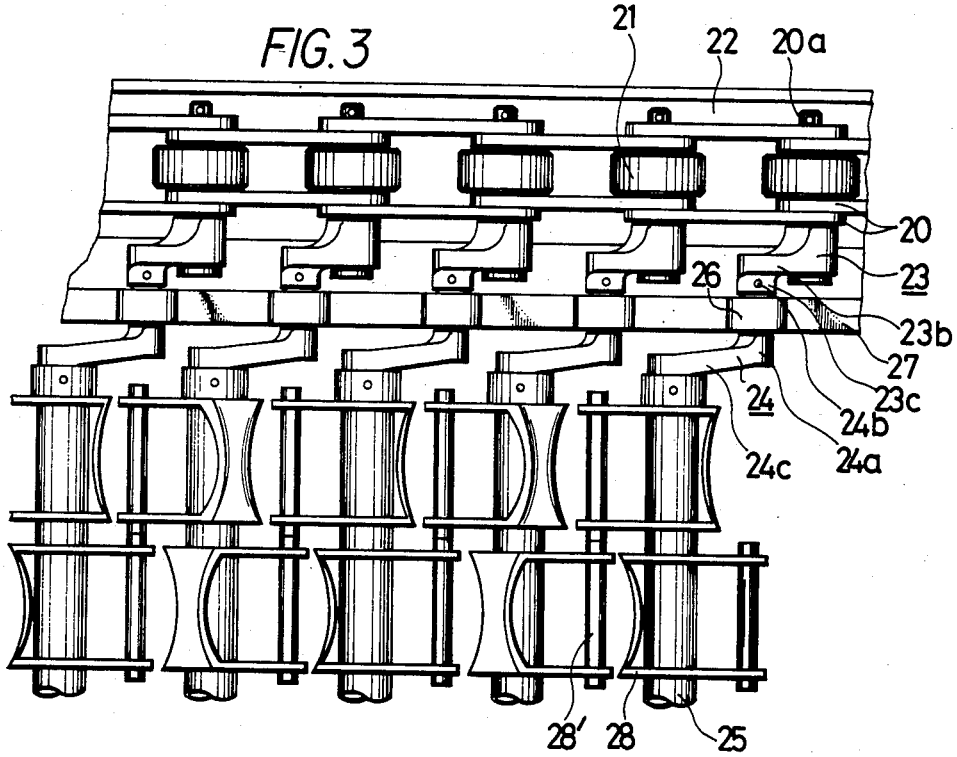
FIG. 3 is a detailed plan view of a zigzag driving portion of a conveyor.
Figure 4:
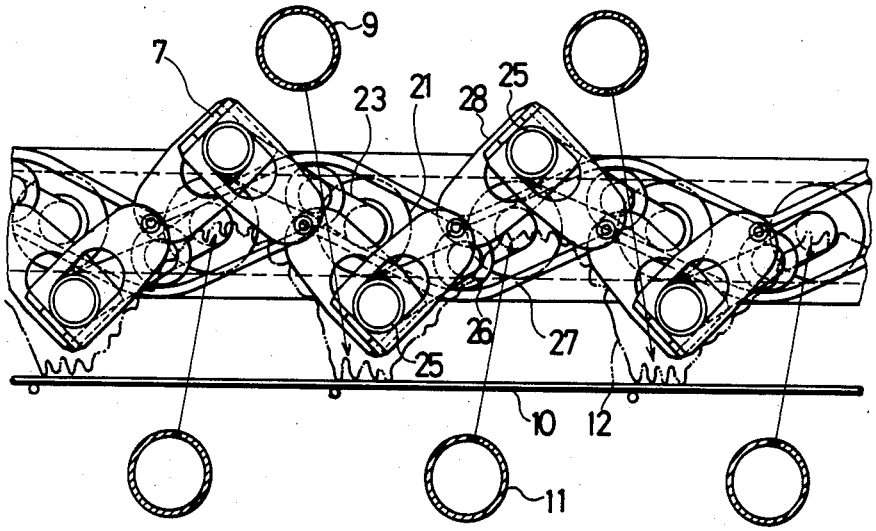
FIG. 4 is a detailed sectional front view of the zigzag driving portion of the conveyor.
Figure 5:
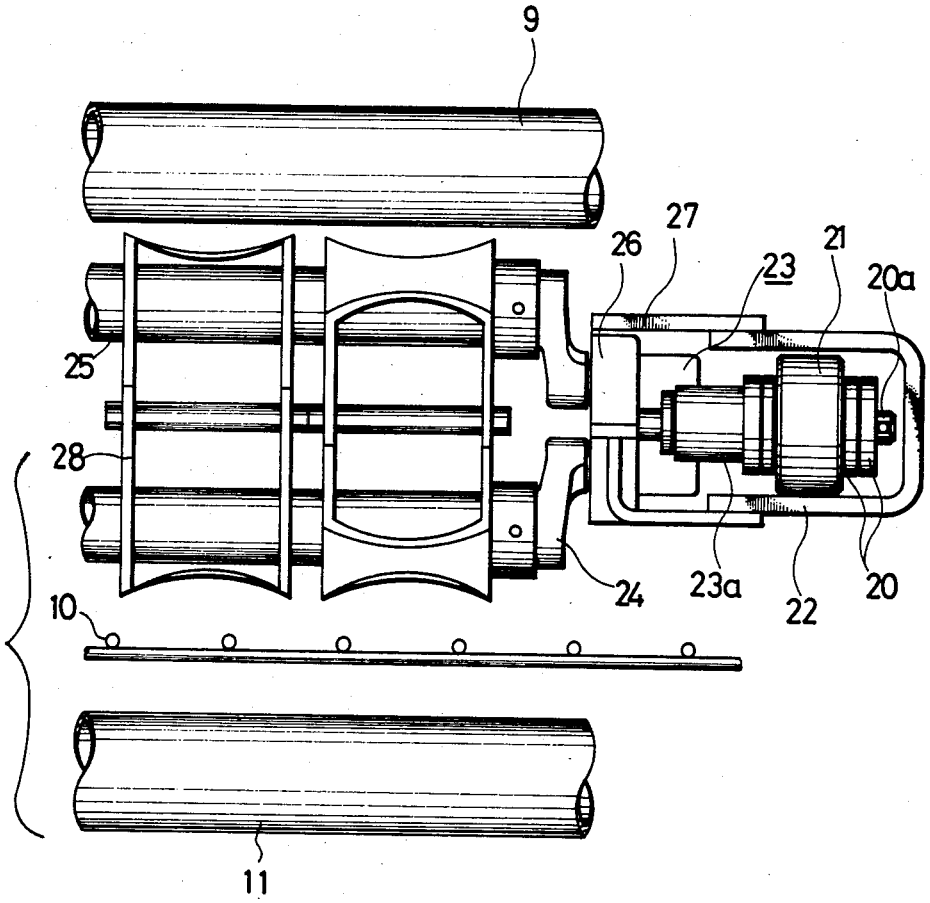
FIG. 5 is a detailed sectional side view of the zigzag driving portion of the conveyor.

An example of means for causing the zigzag motion of the conveyor is shown in FIGS. 3 through 5. In the drawings, rollers 21 are shown fitted so as to idle on the connecting shafts 20*a* of links 20 so that they roll on a flat rail 22 due to the rotation of a chain. Reference numeral 23 denotes a first crank, whose shaft is a hollow shaft 23*a* and is fitted so as to idle on the extended portion of each connecting shaft 20*a*. Reference numeral 23*b* denotes a crank arm, and reference numeral 23*c* denotes a hollow crank pin. A shaft 24*a* of a second crank 24 is fitted into the crank pin 23*c* and is fixed by a pin 24*b*. Reference numeral 24*c* denotes a crank arm.

The link chain and crank means described above are disposed at the right and left extreme ends, and guide bars 25 are stretched between the crank arms 24*c* on both sides.

In the drawings, reference numeral 26 represents a support roller fitted so as to idle on the crank shaft 24*a*, 27 is a zigzag rail for guiding the support roller, and 28 is a ]-shaped member for constituting the conveyors fitted as idlers on and parallel to the guide bar 25, and made of a plastic material or a metal. Elongated holes are bored on both side plates of the ]-shape so that the bar 25 can be fitted into them. A pin 28' to set pitch is formed at the open end of the ]-shape. The members 28 are disposed endlessly over the entire length in order to constitute the conveyor 7.

In the system described above, the cloth 12 is introduced into the cloth treating passage A between the cloth guide 6 and the conveyor 7 by the introduction roller 4 that is set to a speed at least equal to the speed of the conveyor 7, and is conveyed by the movement of the conveyor 7. During the passage of the cloth through this passage A, the cloth 12 is caused to repeatedly rise and fall by the fluid jetted from inside the conveyor 7, whereby the cloth is preliminarily treated at the gaseous phase portion. The cloth 7 is then introduced into the cloth treating passage B between the net 10 and the conveyor 7, and is conveyed by the movement of the conveyor 7. During the passage of the cloth 7 through this passage B, a vigorous buffeting motion is imparted to the cloth by the fluid jetted to the cloth passage B from inside the conveyor and from below the net 10 and by the zigzag motion of the net of the conveyor 7, and while being adjusted by a cloth stay sensor 13, the cloth 12 is expanded and centered by a liquid flow guider 14, then passes through screw rollers 15, 16 and a delivery roller 17, and is thereafter withdrawn sequentially through a submerged roller 18, a guide roller 19, a submerged roller 30 and a guide roller 31.

According to the present invention, the cloth is treated by the conveyor causing a zigzag motion in conjunction with the liquid jet action, thereby reducing, of course, the required pump power. In addition, because the cloth is not conveyed while being interposed between the upper and lower conveyors causing the zigzag motion but is conveyed by the conveyor while only one of the surfaces of the cloth is kept in contact with the conveyor causing the zigzag motion with the other facing the fixed guide member, the cloth is freer than in the interposition system so that the relaxing effect on the cloth as well as the rumpling effect are also greater. Therefore, a treating effect devoid of any transverse wrinkles can be obtained.

The present invention is not particularly restricted to the embodiment described in this specification but all of the modifications within the scope of the invention as set forth in the appended claims are embraced in the present invention.

What is claimed is:

1. In a continuous treating system for a wide cloth which continuously treats said wide cloth while it is being conveyed and passed through a treating tank, containing treating liquid, by a conveyor disposed inside said treating tank; the improvement wherein said conveyor is a single endless conveyor disposed substantially horizontally inside said treating tank;

an upstream portion of said conveyor is disposed above said treating liquid with a downstream portion of said conveyor being submerged in said treating liquid;

a guide disposed spaced above said conveyor so as to face said conveyor defining a first gap between an upper side of said conveyor and said guide, said first gap constituting a gaseous phase passage;

a net stretched spaced below said conveyor so as to face said conveyor defining a second gap between a lower side of said conveyor and said net, said second gap constituting a submerged passage;

means for imparting zigzag motion to said conveyor itself, said means is disposed adjacent said conveyor further defining said submerged passage;

first jet pipes having first jet ports for jetting said treating liquid, said jet ports are open at the inside of said conveyor in such a manner as to face said gaseous phase passage and said submerged passage;

second jet pipes having second jet ports for jetting said treating liquid, said second jet ports are open at a lower part of said net in such a manner as to face said submerged passage; and said single endless conveyor constitutes exclusive means for imparting zig-zag motion to the cloth in cooperation with said jetting, and for contacting said conveyor with only one side of the cloth.

2. The continuous treating system for a wide cloth as set forth in claim 1, wherein said conveyor comprises a plurality of ]-shaped members, first pins which set pitch are respectively disposed at an open end of said members, a guide bar, said members being fitted so as to idle on said guide bar in such a manner as to alternately face opposite directions.

3. The system as set forth in claim 2, wherein said imparting means comprises, flat rails on both sides of said conveyor, rollers rolling on said flat rails, first cranks having hollow shafts, crank arms and hollow crank pins, a plurality of overlapping links having connecting shafts, said rollers and said hollow shafts of said first cranks are idlingly mounted on said connecting shafts, second cranks having crank shafts secured to said hollow crank pins of said first cranks, said guide bar is mounted at its ends to said second cranks, zig-zag rails, support rollers are idlingly mounted on said crank shafts and run on said zig-zag rails.

4. The system as set forth in claim 3, wherein said members have side plates formed with elongated holes, a plurality of said guide bars, said guide bars extend through said holes of said plates of respective of said members.

5. The system as set forth in claim 4, wherein respective of said first pins on respective of said members on a respective one of said guide bars are connected with respective of said first pins on respective of said members on an adjacent respective one said guide bars.

* * * * *